United States Patent [19]

Stringham

[11] 4,300,765

[45] Nov. 17, 1981

[54] BATTING AID

[76] Inventor: Ronald L. Stringham, 158 Ashurst La., Mt. Holly, N.J. 08060

[21] Appl. No.: 974,242

[22] Filed: Dec. 29, 1978

[51] Int. Cl.[3] ..... A63B 69/40

[52] U.S. Cl. ..... 273/26 C; 273/190 C

[58] Field of Search ..... 273/190 R, 190 C, 26 C, 273/26 R, DIG. 17, 191, 183 E, 183 B; 46/73, 23, 60, 61; 272/94, 95; 132/44, 37 A, 1 R

[56] References Cited

U.S. PATENT DOCUMENTS

| | | | |
|---|---|---|---|
| 404,501 | 6/1889 | Pfanne | 132/44 |
| 1,636,086 | 7/1927 | Wolfe | 273/190 C |
| 2,774,601 | 12/1956 | While | 273/190 C |
| 3,162,202 | 12/1964 | Apri et al. | 132/1 R |
| 3,536,329 | 10/1970 | Edwards | 273/190 C |
| 3,779,549 | 12/1973 | MacNeil | 273/190 C |

FOREIGN PATENT DOCUMENTS

| | | | |
|---|---|---|---|
| 2755883 | 12/1977 | Fed. Rep. of Germany | 46/23 |
| 382121 | 9/1907 | France | 46/60 |
| 386340 | 4/1909 | France | 46/60 |

*Primary Examiner*—Richard C. Pinkham
*Assistant Examiner*—T. Brown
*Attorney, Agent, or Firm*—Kenyon & Kenyon

[57] ABSTRACT

The batting aid is constructed with a shoulder piece for fitting against a shoulder and a jaw piece for fitting against a jaw of a batter. The jaw piece is resiliently connected to the shoulder piece to impede motion of the jaw piece towards the shoulder piece when in use. The batting aid serves to aid a batter in maintaining eye-to-ball contact during a swing.

15 Claims, 6 Drawing Figures

BATTING AID

This invention relates to a hitting aid and more particularly to a batting aid for baseball players.

Heretofore, many techniques have been employed to improve the ability of a player to hit a ball with a bat, club, racket or other implement. Generally, these techniques rely upon a repetitive practice routine of swinging at the ball. For example, in the case of baseball players, batting tees, batting practice machines and pitchers have been used to improve a batter's swing and hitting ability. While these techniques have been useful, the degree of success with all players has not been particularly great. Further, relatively long periods of time are required with proper instruction to perfect one's ability through constant practice.

In order to improve a baseball player's ability to hit a pitched ball, stress is usually placed on the importance of the batter keeping his head in on the ball as the ball appraoches the hitting zone since this will allow the batter to see the ball as long as possible with both eyes to the point of contact. If the batter follows the ball until the point of contact with a bat, his head should almost be touching his rearmost shoulder when contact is made with the ball and as he follows through on his swing. If the batter allows his head to come around with his forward shoulder as he starts to swing, he partially loses visual eye-to-ball contact. A batter who develops his habit may also be swinging the bat in the same plane all the time no matter where the ball is in relation to the strike zone. Such a batter does not usually adjust his swing to the pitch and is therefore unable to hit the ball where the ball is pitched and is unable to hit to different areas of the field.

Generally, the problem of keeping one's head in is a matter of mental discipline which requires concentration. This is often very difficult and very frustrating to a batter.

Accordingly, it is an object of the invention to provide a relatively simple device to improve the hitting ability of a batter.

It is another object of the invention to provide a batting aid for a baseball player which will enable a batter to keep his head in with every pitch.

It is another object of the invention to provide a batting aid which can improve the batting stance of a batter.

It is another object of the invention to provide a batting aid which can be constructed in a relatively simple manner of few parts.

It is another object of the invention to provide a batting aid which can be worn during practice game conditions.

Briefly, the invention provides a batting aid which is comprised of a shoulder piece for positioning on a shoulder of a batter, a jaw piece for positioning against the jaw of a batter and means which connect the shoulder piece and jaw piece together in spaced relation to each other in order to impede movement of the jaw of the batter towards the shoulder during a swing.

In one embodiment, the connecting means is resilient in a longitudinal direction to permit pressing of the jaw piece towards the shoulder piece. In this case also, each of the shoulder piece and jaw piece is rotatably mounted so as to be adjusted to the shoulder and jaw of a batter. For example, the connecting means includes a stem on the jaw piece and an elastically compressible sleeve on the shoulder piece which is sized to receive the stem in slidable relation.

The jaw and shoulder pieces can be made of any suitable soft material to be cushioned against the jaw and shoulder of a batter. For example, each piece may be made of soft rubber. Also, each of the shoulder and jaw pieces may be contoured in order to be comfortably positioned against the shoulder and jaw of a batter.

The batting aid can be provided with a necklace or chain to be worn about the neck of a batter. In this case, the means connecting the shoulder and jaw pieces together can be slidably mounted on the necklace.

Alternatively, the batting aid can be constructed for mounting on a batting helmet. To this end, the connecting means may have a connecting arm fixed to and extending therefrom intermediately of the jaw and shoulder pieces as well as a means at the end of the connecting arm for attaching to an ear piece of the helmet e.g. by fitting into an ear hole of the batting helmet.

The use of the batting aid is based upon a theory of conditioned response. In this regard, when a batter is positioning himself in a batting stance, the batting aid is put into place with the jaw piece against the jaw and the shoulder piece resting on the batter's forward shoulder, i.e. the shoulder facing a pitcher. Suitable adjustments are made so that the shoulder and jaw pieces fit comfortably. At this time, the batter should be facing the pitcher so that both eyes are on the ball which is to be thrown. At the same time, the batter's shoulders will be aligned such that the rear shouler is even or slightly above the forward shoulder. Also, the batter's hands should be aligned about shoulder height.

Should the batter turn his head towards his front shoulder, the batting aid will impede this motion by creating a constant or continued pressure between the jaw and shoulder. This will indicate to the batter that his head is moving out. It is also possible for the batter's head to come in with the pitch and back out on the swing. In this case, the batter will experience a relief of pressure and the contact with the batting aid again when the aid is attached to a helmet.

Should the batter swing properly, i.e. by watching the thrown ball and keeping his head in, his forward shoulder will move away from his jaw as his swing begins to take place so that the batting aid will drop out of place. This will indicate that the batter has kept his head in.

Repeated use of the batting aid should condition a batter to keep his head in while a ball is pitched to him. How fast the response is learned is a matter of repitition. In this regard, the batter may wish to use the batting aid only in practice or he may also use the batting aid, rules permitting, in a game condition.

In the embodiment where the batting aid is disposed on a necklace, the batter may continue to wear the aid while in the field. In the embodiment where the batting aid is mounted on a batting helmet, the aid may be removed with the helmet when not in use.

These and other objects and advantages of the invention will become more apparent from the following detailed description taken in conjunction with the drawings wherein.

Figure 1:
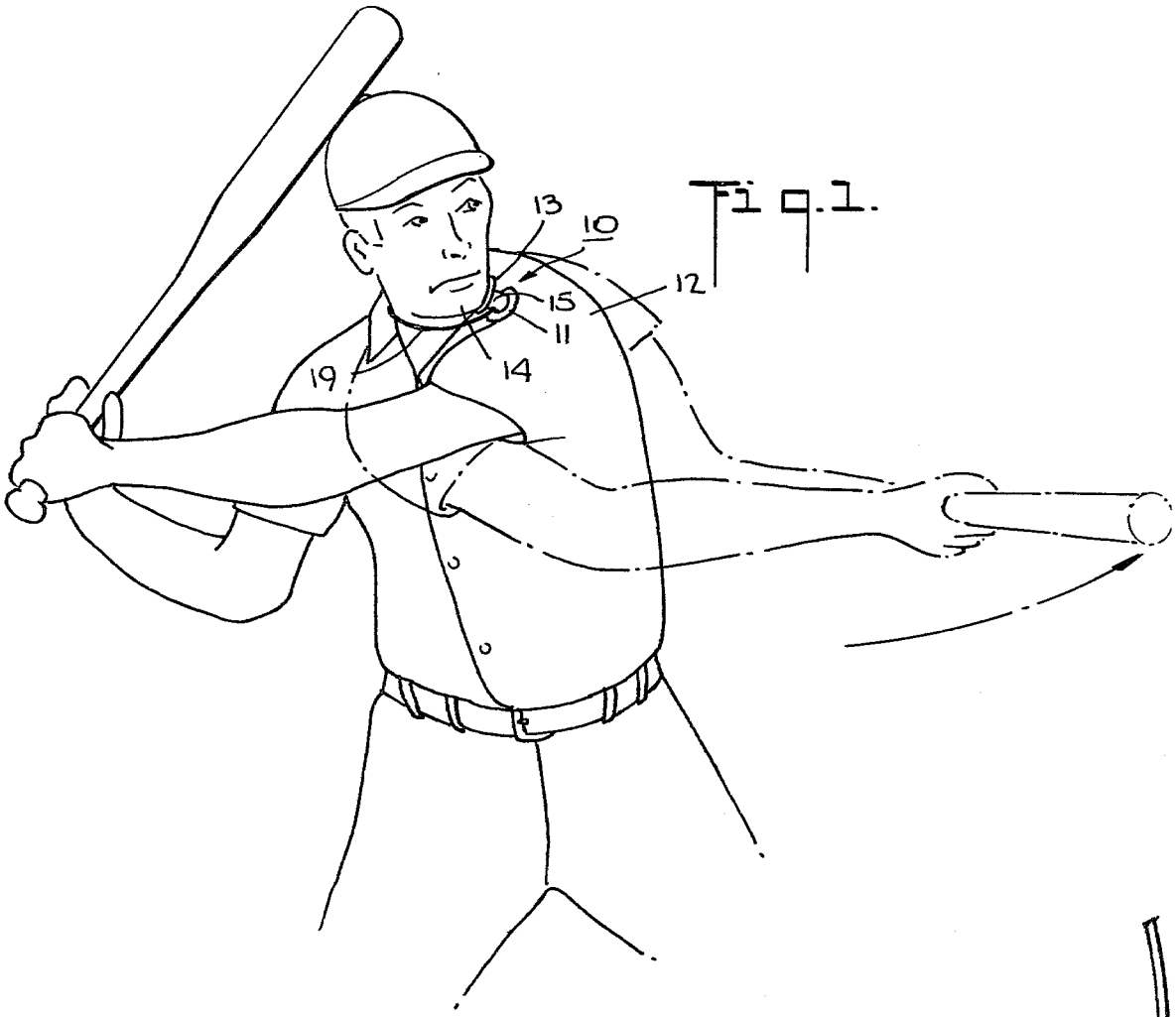
FIG. 1 illustrates a view of a batter in a batting stance with a batting aid according to the invention in place.
Figure 2:
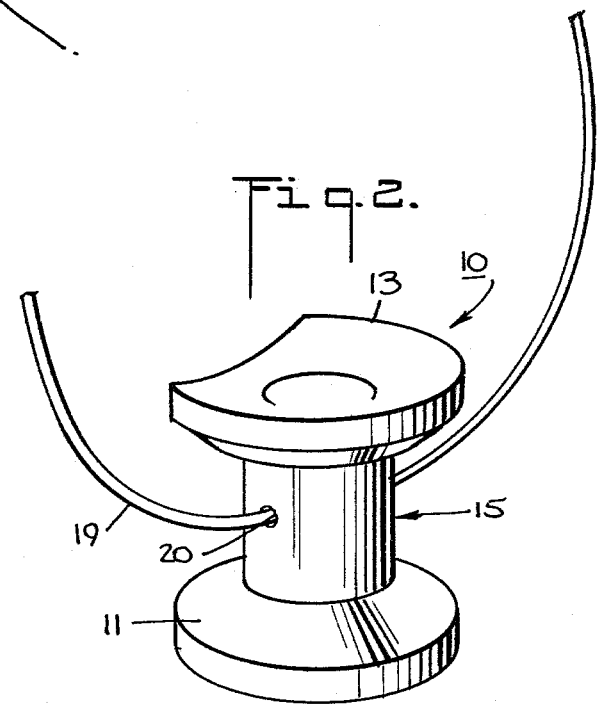
FIG. 2 illustrates a perspective view of a batting aid in accordance with the invention.

Referring to FIGS. 1 and 2, the batting aid 10 is comprised of a contoured self-supporting shoulder piece 11 for positioning on a forward shoulder 12 of a batter, a contoured self-supporting jaw piece 13 having a recessed circular shape for positioning against a jaw 14 of the batter and a means 15 connecting the shoulder piece 11 and jaw piece 13 together in space coaxial relation to each other in order to impede movement of the jaw 14 of the hitter towards the shoulder 12 during a swing.

The connecting means 15 is composed of a sleeve 16 of elastically resilient material which is integral with the shoulder piece 11 and a steam 17 which is integral with the jaw piece 13. The shoulder and jaw pieces 11, 13 are made of a soft material such as soft rubber while the stem 19 is fitted into a recess 18 of the sleeve 16. The stem 17 and recess 18 are shaped in mating relation to each other so as to permit rotation of the pieces 11, 13 relative to each other. This allows the shoulder and jaw pieces 11, 13 to be adjusted in position.

The batting aid 10 is compressible so that the jaw and shoulder piece 11, 13 will adjust to differently sized ball players. For example, the shoulder and jaw pieces 11, 13 may be depressed a greater or lesser amount to provide a longitudinal adjustment, for example within a one inch range. The amount of adjustment needed depends on how the batting aid is worn in relation to the individual's stance forward or back of the jaw line.

Figure 3:
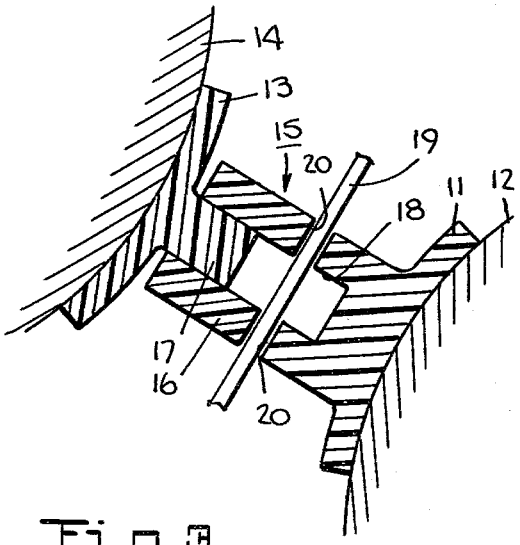
FIG. 3 illustrates an enlarged view of a batting aid in place between a jaw and a shoulder of a batter.

The batting aid 10 also has a necklace or the like 19 which is sized to fit around the neck of the batter. The sleeve 16 of the shoulder piece 11 is slidably mounted on the necklace 21 in any suitable fashion, for example, the sleeve 16 is provided with a pair of diametrically opposed openings 20 (FIG. 3) through which the necklace 19 is threaded. In this regard, the necklace 19 may be made of any suitable material for positioning about the neck of the batter. In addition, the necklace 19 may be provided with a suitable clip or catch to permit fastening about the neck of the batter.

During use, the batting aid 10 is positioned by the batter between his foward shoulder and his jaw (FIG. 1). In this position, the batting aid 10 is comfortably positioned to be retained between the jaw and shoulder. At the same time, the batter's shoulders should be aligned such that the rear shoulder is even or slightly above the forward shoulder while the batter's hands are at shoulder height. In this position, the batter's eyes should both be horizontal to the pitcher (not shown) so as to clearly see the ball which is thrown.

As a pitch is thrown, the eyes of the batter should follow the ball inwardly into the hitting zone of the batter. At this time, if the batter swings correctly, the batting aid 10 will fall from the position between the jaw 14 and shoulder 12. Should the batter swing and hit the ball, the batter may then run to first base. Should the batter swing and miss the ball or foul the ball off, or come out of his stance to avoid a bad pitch, the batting aid 10 is simply put back in place between the jaw 14 and shoulder 12 for the next pitch.

The batting aid 10 is not visible to the batter while being worn and should no hinder his vision in any way.

Figure 4:
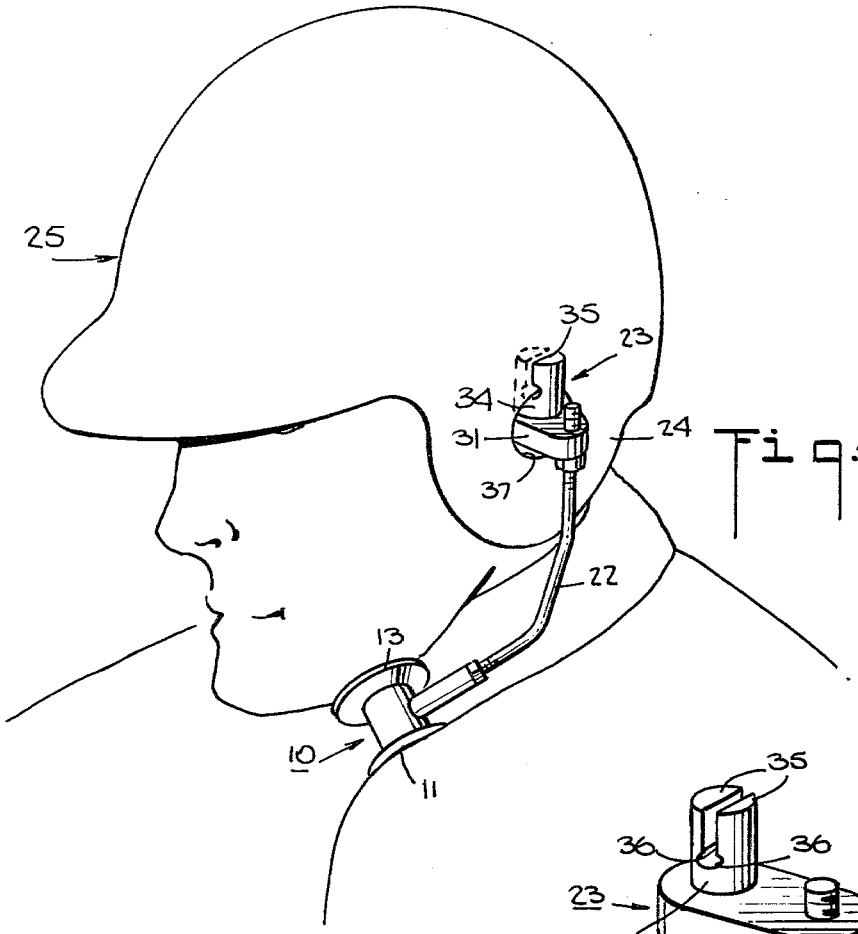
FIG. 4 illustrates a modified batting aid for mounting on a helmet in accordance with the invention.
Figure 6:
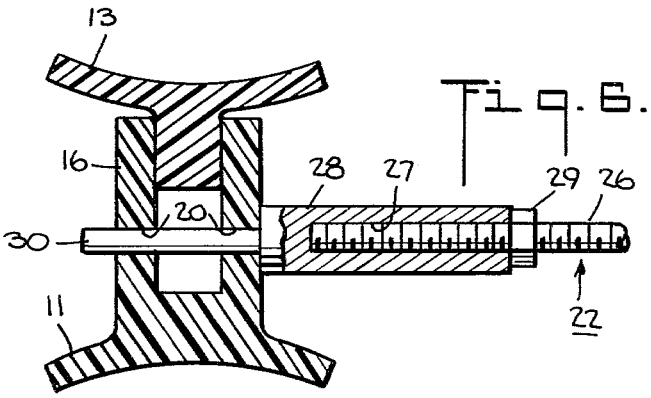
FIG. 6 illustrates a cross-sectional view of the batting aid and mounting means of FIG. 4.
Figure 5:
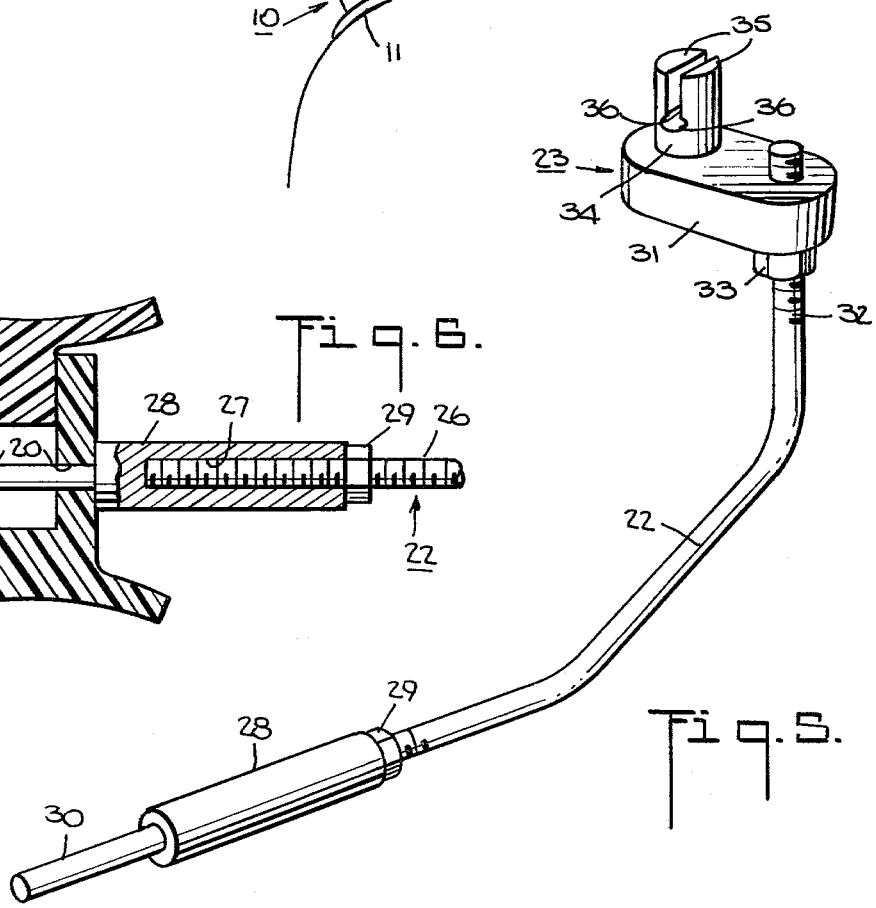
FIG. 5 illustrates a means for mounting a batting aid on a batting helmet in accordance with the invention.

Referring to FIGS. 4 to 6, wherein like reference characters indicate like parts as above, the batting aid 10 may also be constructed so as to be supported on a batting helmet 21 rather than about the person of the batter. To this end, a connecting arm 22 is secured at one end to the sleeve 16 and carries a means 23 at the opposite end for attaching to an ear piece 24 of a batting helmet 25 in order to support the batting aid 10 from the helmet 25. As shown in FIGS. 5 and 6, the arm 22 has a threaded end 26 which is threaded into a threaded bore 27 of a pin 28 and held in place by a nut 29 tightened against the end of the pin 28. The pin 28, in turn, has a cylindrical extension 30 which is slidably mounted in the openings 20 of the sleeve 16. The means 23 at the other end of the arm 22 includes a mounting block 31 which is threaded onto a threaded end 32 of the arm 22 and held in place by a nut 33 tightened against the block 31 as well as a clip 34 which is rotatably mounted in the block 31. The clip 34 is bifurcated to have two legs 35 which are spaced apart by a suitable gap and each leg 35 has a recess 36 at the end closest the block 31 to allow some degree of flexibility. The clip 34 is secured in the block 31 in a friction fit manner to permit mounting of the clip 34 in an upward direction as shown in FIG. 4 of a downward direction.

In order to mount a batting aid 10 on the helmet 25, the clip 34 is inserted in an earhole 37 of the ear piece 24 with the legs 35 straddling the ear piece 24. The block 31 is also inserted in the ear hole 37. This provides a tight fit; however, the arm 22 can be rotated in the block 31 for adjustment purposes. The batting air 10 is then slid onto the cylindrical extension 30 of the pin 29. Suitable adjustments can be made; e.g. by rotating the pin 28 and nut 29 and the arm 22 in the block 31. Alternatively, the batting aid 10 may be mounted on the arm 22 before the arm 22 is attached to the helmet 25.

Alternatively, the batting aid can be hung from the ear hole of a helmet by a suitable clip or other means (not shown).

The invention thus provides a batting aid which is very light and should not feel uncomfortable to a batter. The batting aid can be made of materials which are unbreakable, that is the materials will not splinter, shatter or break leaving sharp edges which might otherwise cause a risk of injury to the user. The batting aid also should not hinder movement of the batter's head if the batter has to avoid a bad pitch thrown at him. Where mounted on a batting helmet, the batting aid can be constructed to disengage if the helmet is hit with a ball.

What is claimed is:

1. A batting aid comprising a contoured self-supporting shoulder piece for positioning on a shoulder of a batter;

a contoured self-supporting jaw piece for positioning against the jaw of the batter; and means connecting said shoulder piece and said jaw piece together in spaced adjustable relation to each other, said means being longitudinally resilient to permit pressing of said jaw piece towards said shoulder piece, said means including a stem on one of said pieces and an elastically compressible soft rubber sleeve on the other of said pieces having said stem slidably received therein.

2. A batting aid as set forth in claim 1 wherein said jaw piece is rotatably mounted relative to said shoulder piece and has a recessed circular shape to fit against the jaw of a batter.

3. A batting aid as set forth in claim 1 which further comprises a necklace having said means slidably mounted thereon, said necklace being sized to fit about the neck of a batter.

4. A batting aid as set forth in claim 1 which further comprises a connecting arm fixed to and extending from said stem intermediately of said pieces and means at one end of said connecting arm for fitting into an earhole of a batting helmet whereby the batting aid can be supported from the batting helmet.

5. A batting aid as set forth in claim 1 which further comprises a necklace having said sleeve slidably mounted thereon, said necklace being sized to fit about the neck of a batter.

6. A batting aid comprising a shoulder piece for positioning on a shoulder of a batter, said shoulder piece having an upstanding elastically compressible sleeve disposed thereon; and a jaw piece for positioning against the jaw of the batter, said jaw piece having a recessed shape to fit against a jaw and a stem slidably received in said sleeve to space said jaw piece from said shoulder piece and to impede movement of the jaw of the batter towards the shoulder of the batter.

7. A batting aid as set forth in claim 6 wherein said jaw piece is of generally circular shape with a flat edge for positioning against a jaw.

8. A batting aid as set forth in claim 6 wherein each said piece is made of a soft rubber.

9. A batting air as set forth in claim 6 wherein said jaw piece is rotatably mounted in said sleeve.

10. A batting aid as set forth in claim 6 wherein said sleeve is elastically deformable along a longitudinal axis and said pieces are disposed at opposite ends of said axis.

11. A batting aid as set forth in claim 10 wherein said sleeve is a rubber sleeve.

12. A batting air as set forth in claim 6 which further comprises a connecting arm secured to and extending from said sleeve, and means at one end of said arm for attaching to an ear piece of a batting helmet to support the batting aid from the batting helmet.

13. A batting aid as set forth in claim 1 which further comprises a necklace sized to fit about the neck of a batter to hold said aid about the neck of a batter.

14. A batting aid for improving eye-to-ball coordination of a batter during a swing, said aid comprising a contoured shoulder piece for positioning on a forward shoulder of the batter;

a contoured jaw piece having a recessed shape for positioning against a jaw of the batter; and means connecting said shoulder piece and said jaw piece together in spaced coaxial relation to each other to impede movement of the jaw of the hitter towards the shoulder of the hitter during a swing, said means including a stem on one of said pieces and an elastically compressible soft rubber sleeve on the other of said pieces having said stem slidably received therein.

15. An aid for improving eye-to-ball coordination comprising a shoulder piece for positioning on a shoulder of a person, said shoulder piece having an elastically compressible sleeve thereon;

a jaw piece for positioning against the jaw of the person, said jaw piece having a recessed shape to fit against a jaw and a stem slidably received in said sleeve to position said jaw piece in spaced adjustable relation to said shoulder piece; and a necklace having said sleeve slidably mounted thereon, said necklace being sized to fit about the neck of the person.

* * * * *

UNITED STATES PATENT AND TRADEMARK OFFICE

CERTIFICATE OF CORRECTION

PATENT NO. : 4,300,765

DATED : November 17, 1981

INVENTOR(S) : Ronald Stringham

It is certified that error appears in the above—identified patent and that said Letters Patent is hereby corrected as shown below:

Column 1, line 29, after "develops" change "his" to --this--

Column 3, line 16, change "space" to --spaced--

Column 3, line 21, change "steam" to --stem--

Column 3, line 30, after "shoulder" change "piece" to --pieces--

Column 3, line 49, change "foward" to --forward--

Column 4, line 2, after "should" change "no" to --not--

Column 4, line 26, change last word "of" to --or--

Column 4, line 33, after "batting" change "air" to --aid--

Column 5, line 34, after "batting" change "air" to --aid--

Column 6, line 3, after "batting" change "air" to --aid--

Signed and Sealed this

*Sixteenth* Day of *March 1982*

[SEAL]

*Attest:*

GERALD J. MOSSINGHOFF

*Attesting Officer*

*Commissioner of Patents and Trademarks*